US008590625B1

(12) United States Patent
Smith et al.

(10) Patent No.: US 8,590,625 B1
(45) Date of Patent: Nov. 26, 2013

(54) SUBSEA COMPLETION WITH A TUBING SPOOL CONNECTION SYSTEM

(71) Applicant: Cameron International Corporation, Houston, TX (US)

(72) Inventors: Stephen C. Smith, Houston, TX (US); David R. June, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 13/712,441

(22) Filed: Dec. 12, 2012

Related U.S. Application Data

(60) Provisional application No. 61/735,531, filed on Dec. 10, 2012.

(51) Int. Cl.
*E21B 34/06* (2006.01)

(52) U.S. Cl.
USPC ..... 166/344; 166/348; 166/360; 166/368; 166/373; 285/123.2

(58) Field of Classification Search
USPC ..... 166/363, 338, 344, 348, 351, 360, 368, 166/373, 378, 379, 88.4; 285/123.1, 123.2
See application file for complete search history.

(56) References Cited

U.S. PATENT DOCUMENTS 4,491,176 A * 1/1985 Reed ..... 166/66.4
4,607,691 A * 8/1986 Bridges ..... 166/88.4
5,465,794 A * 11/1995 McConaughy et al. ..... 166/375
5,558,532 A * 9/1996 Hopper ..... 439/310
6,082,460 A * 7/2000 June ..... 166/348
6,102,124 A * 8/2000 Skeels et al. ..... 166/347
6,200,152 B1 * 3/2001 Hopper ..... 439/310
6,681,861 B2 * 1/2004 Davidson et al. ..... 166/382
6,942,028 B2 * 9/2005 Hosie ..... 166/88.4
7,013,970 B2 * 3/2006 Collie et al. ..... 166/89.1
7,331,396 B2 * 2/2008 Reimert et al. ..... 166/368
7,699,099 B2 * 4/2010 Bolding et al. ..... 166/89.1
7,909,103 B2 * 3/2011 Fenton ..... 166/348
8,157,015 B2 * 4/2012 Voss et al. ..... 166/368
8,322,441 B2 * 12/2012 Fenton ..... 166/368
2010/0294492 A1 * 11/2010 June et al. ..... 166/255.2

* cited by examiner

*Primary Examiner* — Matthew Buck
(74) *Attorney, Agent, or Firm* — Chamberlain Hrdlicka

(57) ABSTRACT

A subsea completion for a well is presented that includes a tubing spool, a tubing hanger, a fluid coupling, an electrical coupling, a control system, a valve, and a production tree. The tubing spool includes a central bore, a side wall, and a fluid supply passage extending through the tubing spool. An electrical supply passage can also extend through the side wall of the tubing spool. The tubing hanger includes a fluid control passage. The tubing hanger can also include an electrical control passage. The control system includes a fluid control conduit to provide fluid to the tubing spool fluid supply passage from outside the tubing spool. The valve is connectable to the outside of the tubing spool to control fluid flow between the control system fluid conduit and the tubing spool fluid supply passage.

11 Claims, 3 Drawing Sheets

SUBSEA COMPLETION WITH A TUBING SPOOL CONNECTION SYSTEM

BACKGROUND

To meet the demand for natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a completion system that includes wellhead assembly through which the resource is extracted. These completion systems may include a wide variety of components, such as various casings, hangers, valves, fluid conduits, and the like, that control drilling and/or extraction operations.

One type of completion assembly includes a wellhead with one or more strings of casing supported by casing hangers in the wellhead. Attached to the wellhead is a tubing spool and a tubing hanger secured to a string of tubing lands in the tubing spool above the wellhead. The tubing hanger has a plurality of vertical passages that surround a vertical bore. The vertical fluid passages provide access through the tubing hanger for hydraulic fluid or electrical lines to operate and control equipment located downhole such a safety valves or chemical injection units. Electrical and/or hydraulic control lines extend below the tubing hanger alongside the outside of the tubing to control downhole valves, temperature sensors, and the like.

A production tree is installed on top of the tubing spool. The production tree has a vertical bore that receives upward flow of fluid from the tubing string and tubing hanger. The tree has valves for controlling flow from the well. The vertical passages in the tubing hanger connect with vertical connectors protruding downward from the tree. The passages in the tree are in communication with a control unit in the tree.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Figure 1:
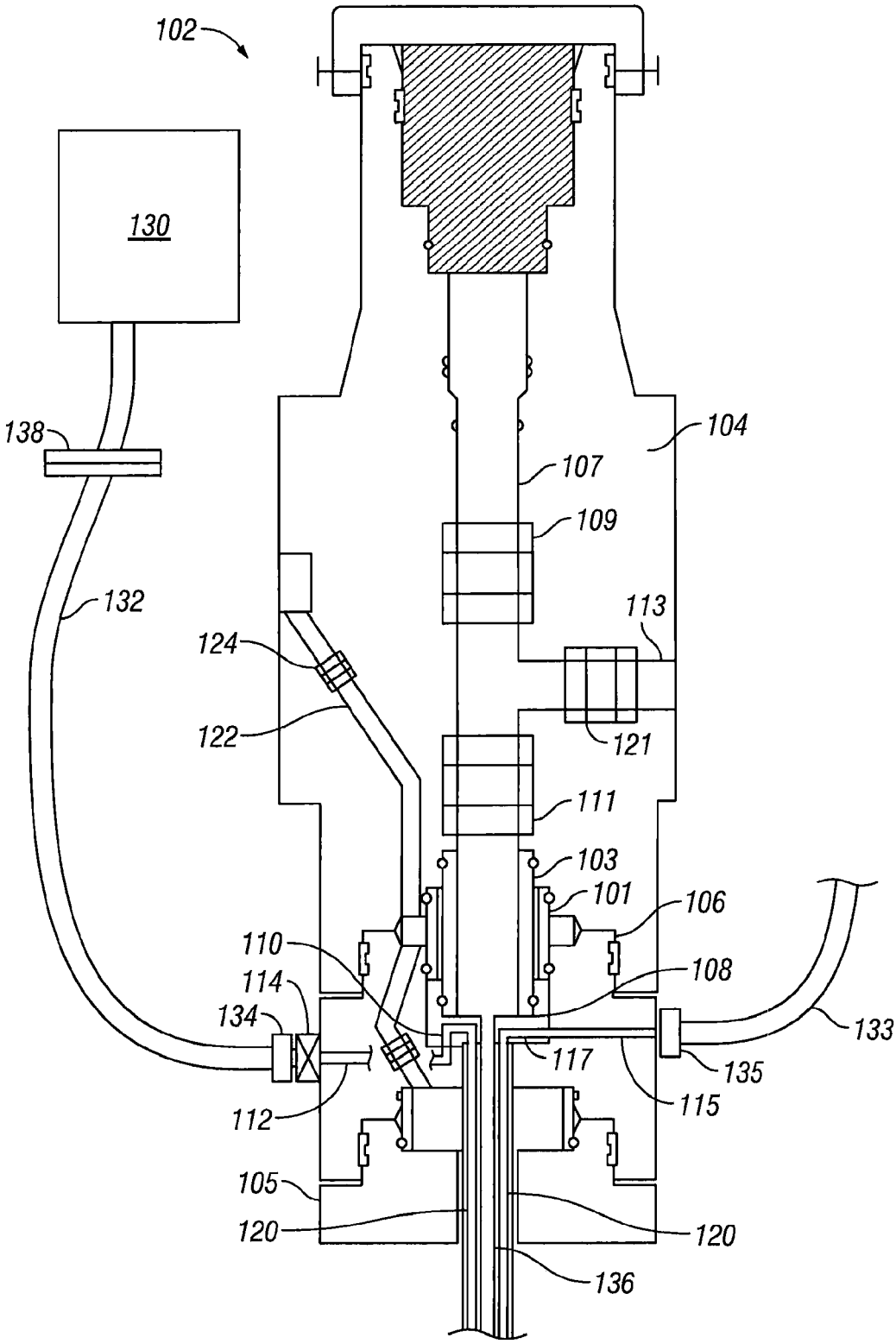
FIG. 1 is an illustrative production and completion system.

FIG. 1 shows a subsea completion and production system 102 that includes a subsea production tree 104 installed on a tubing spool 106, which is installed on a wellhead 105. The subsea production tree 104 has a vertical bore 107 and production valves 109, 111 are located in bore 107, thus making the tree 104 a vertical tree. The tree 104 also has a horizontal production passage 113 extending from the bore 107 and containing valve 121. Both the tubing spool 106 and the production tree 104 include an annulus bypass 122 with valves such as 124.

Landed in the tubing spool 106 is a tubing hanger 108 supporting a production tubing string 136. The subsea tree 104 has a production stab mandrel 103 that connects to the production bore of the tubing hanger 108 for communication of well fluids from the production tubing string 136. Other than the production stab 103, the subsea tree 104 does not make direct hydraulic and electric connections to the tubing hanger 108 via vertical coupling connections inside the tree 104 and the tubing spool 106. Instead, the downhole hydraulic and electrical connections are made through the outside of the tubing spool 106 and then to the tubing hanger 108 as explained further below. Thus, there is no need for fine alignment between the subsea tree 104 and the tubing hanger 108 when installing the tree 104. The subsea tree 104 may thus be connected to the tubing hanger without orientation to the tubing hanger 108. Because the internal connections are removed, there may also not be a need for an isolation sleeve 101 between the tubing spool 106 and the tree 104.

Various downhole fluid supply functions, such as downhole safety valves for tubing strings, or downhole chemical injection, are supplied with fluid from a surface fluid source for subsea operations. For this purpose, hydraulic control fluid couplings or connectors are provided between tubing spool 106 and the tubing hanger 108. As shown, the tubing hanger 108 includes at least one control fluid passage 110 outside the production bore and extending from outside the tubing hanger 108. The tubing hanger control fluid passage 110 communicates with a corresponding control fluid line 120 extending from the tubing hanger 108 downhole outside of the production tubing 136. The control fluid line 120 extends downhole and may be used to provide hydrualic control for equipment downhole in the well, such as safety valves, e.g., a subsea safety valve (SSV). The tubing spool 106 includes at least one corresponding fluid supply passage 112 in communication with the tubing hanger control fluid passage 110. The tubing hanger control fluid passage 110 and the tubing spool fluid supply passage 112 may be oriented in any suitable configuration, horizontal or vertical.

Figure 2:
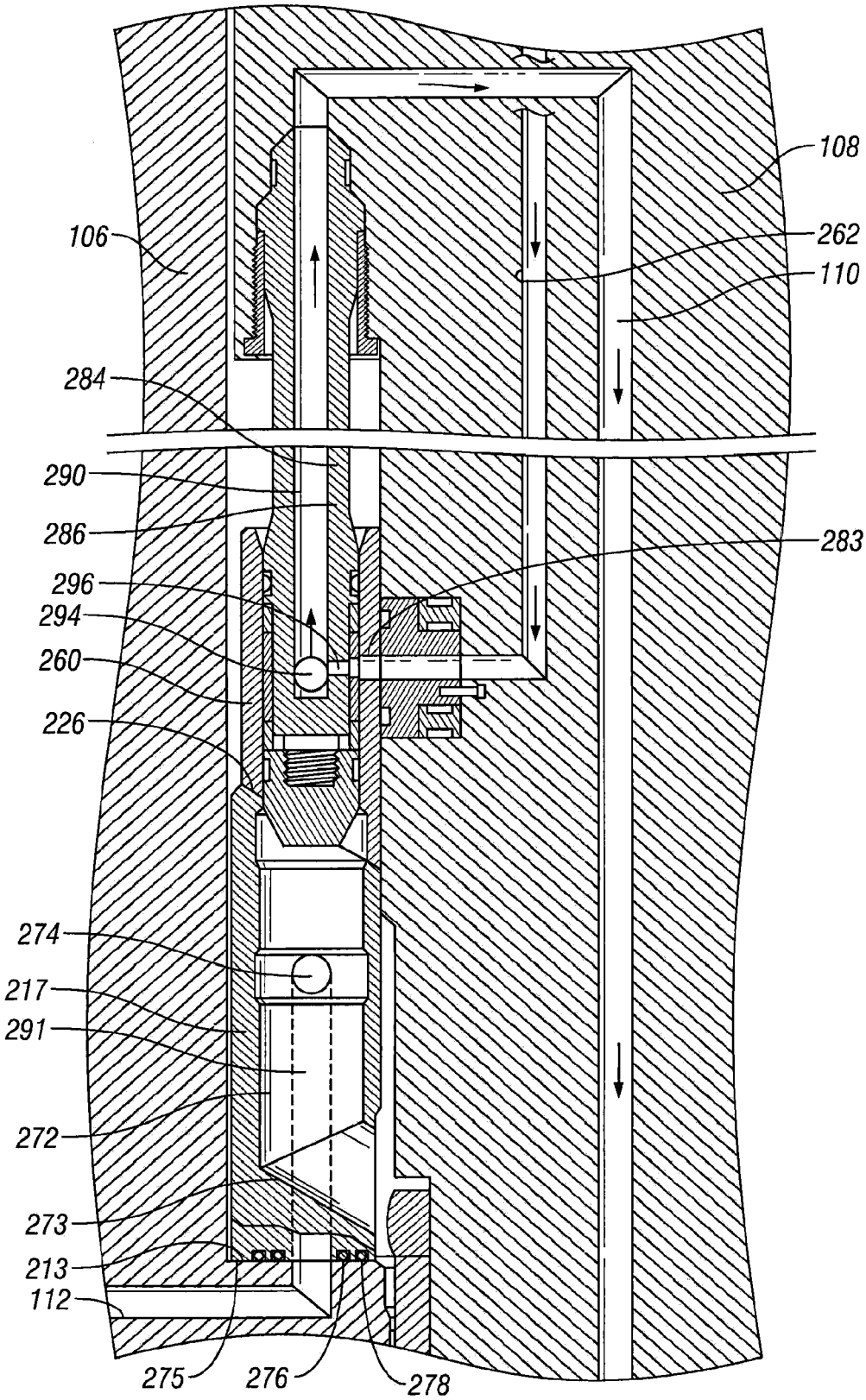
FIG. 2 is an illustrative, sectional view of the connection through the tubing spool and tubing hanger prior to the landing of the tubing hanger.
Figure 3:
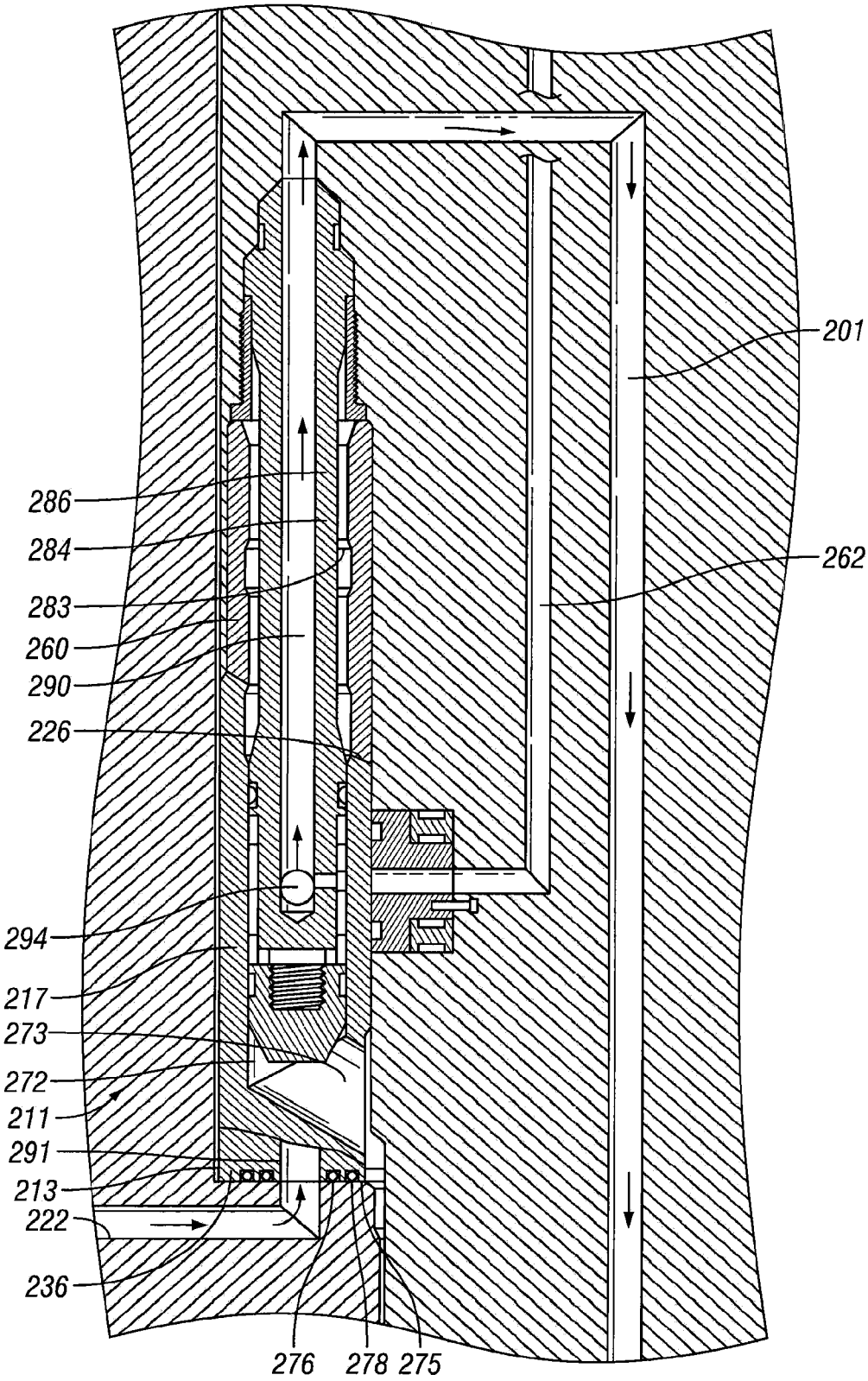
FIG. 3 is an illustrative, sectional view of the connection through the tubing spool and tubing hanger after landing of the tubing hanger.

FIGS. 2-3 illustrate an embodiment of a fluid coupling that forms a connection and sealing arrangement between the tubing spool 106 and the tubing hanger 108. The coupling means between the tubing hanger 108 and the tubing spool 106 includes a lower ring 217 landed in the tubing spool 106 and an upper ring 260 mounted on the tubing hanger 108 for sliding movement relative to the tubing hanger 108. Although shown as separate, the ring 217 may optionally be integral with the tubing spool 106. Axial openings in the rings 217, 260 are adapted to align vertically and a stab pin assembly 284 carried by the tubing hanger 108 is received within the vertically aligned openings in the landed position of the tubing hanger 108.

As shown in FIGS. 2-3, a stab pin assembly 284 has a stab pin 286 received within the slidable ring 260. A ring 217 has an upper landing shoulder 226. A lateral port 283 in the ring 260 is aligned with port 296 in the stab pin 286 when tubing hanger 108 is connected to a running tool and being lowered within the well in which a control fluid passage 262 is in fluid communication with the main control fluid passage 110.

The tubing spool 106 has a planar horizontal shoulder 213 and the ring 217 has an axial opening 272 angled inwardly at 273. A planar bottom surface 275 of the ring 217 contacts the tubing spool shoulder 213 along its entire lower circular periphery. Sealing rings 276 and 278 between planar surfaces 213 and 275 on the tubing spool 106 and the ring 217 provide effective sealing about the control fluid supply passage 112 from the tubing spool 106. A cross port 294 in the stab pin 286 communicates with the bore 290 in the stab pin 286 and with the branch control fluid passage or port 291 in the ring 217. A sealing arrangement is provided for the communication of the port 291 in the ring 217 to the control fluid supply passage 112 through the tubing spool 106, particularly in the landed position of tubing hanger 108.

In operation, a running tool (not shown) is connected to the tubing hanger 108 for lowering tubing hanger 108 within the well for landing in the tubing spool 106. Before landing, control fluid is supplied continuously by the running tool to each downhole function for control thereof while tubing hanger 108 is being lowered.

As the tubing hanger 108 and stab pin 286 move downwardly from the position of FIG. 2 to the landed position of FIG. 3, the hanger shoulder contacts the upper end of the ring 260. In the landed position, the ports 274 and 294 are in fluid communication with each other and with axial bore 290 of the stab pin 286. Control fluid is thus supplied to the main control fluid passage 110 from the tubing spool 106 through the fluid supply passage 112, and ports 274 and 294 to the control fluid passage 120.

Additionally, some embodiments may include more than one control fluid passage 110 and control fluid supply passage 112 communicating with respective control lines 120 running downhole. Additionally, the control fluid passages 110 may be spaced vertically from each other, rather than being horizontally spaced. If arranged horizontally, orientation may be required and the tubing spool 106 may include a guide means or orientation device (not shown). The guide means or orientation device may be used to rotationally orient the tubing hanger 108 in a known orientation to know which downhole function is controlled by which tubing spool fluid supply passage 112. For example, the tubing hanger 108 may include an orienting sleeve for engaging the tubing spool 106 and landing in a known orientation. With the known orientation, connections can be made to control the proper downhole functions.

Referring again to FIG. 1, the tubing spool fluid supply passage 112 aligns for communication with a tubing hanger control fluid passage 110 and a valve 114 is mounted to the tubing spool 106 to control fluid flow through the tubing spool fluid supply passage 112. A corresponding line connector 134 attaches to the tubing spool valve 114. In this way, hydraulic fluid communication is established between the tubing spool fluid supply passage 112 and a control unit 130 through a line 132. The connection may be any suitable connection depending on the environmental conditions. For example, the connection may be a G2 control line connection from Cameron International Corporation that allows for flushing with rust inhibitors when made up. The G2 control line connection from Cameron International Corporation is disclosed in U.S. Pat. No. 6,082,460, and is hereby incorporated by reference for all purposes. Alternatively, the control valve 114 may be part of the line 132 and connectable with the tubing spool 106. The valve 114 may be suitable valve actuated by any suitable means. For example the valve 114 may be a check valve or hydraulically actuated by fluid in line 132. The valve 114 may also be actuated between open and close positions with a remotely-operated vehicle (ROV).

In addition to the hydraulic control fluid connection the completion may optionally include electrical supply passages and couplings. As shown in FIG. 1, the tubing spool 106 includes an electrical supply passage 115 that extends through the side wall of the tubing spool 106 and aligns for communication with a tubing hanger electrical passage 117. A corresponding line connector 135 is mounted to the tubing spool 106 to supply electrical power for downhole functions. For example, electrical power can be supplied for powering downhole equipment such as sensors. In addition, electrical communication is established between the tubing spool electrical supply passage 115 and the control unit 130 through a line 133. The connection here may also be any suitable connection depending on the environmental conditions Also included in the subsea completion is a control system 130 that issues commands for operating the downhole equipment and controls the operation of the downhole equipment by regulating fluid communication through the control fluid line 120. Although shown as separate, in some embodiments, the control unit 130 may be integral with the production tree 104. The control unit 130 may also be located near the production tree 104 or may be located remotely, such as at the water surface. Normally, the production tree 104 houses the control valve 114 internally. However, with the control valve 114 located at the tubing spool 106, the production tree 104 no longer needs to include such a valve. Locating the valve 114 externally from the control system 130 allows direct access to the valve 114 for possible servicing or replacing.

In operation, the control unit 130 provides electrical signals and hydraulic pressure to control equipment downhole in the well. The hydraulic pressure is supplied through the line 132 and the valve 114, which leads to the tubing spool fluid supply passage 112, the tubing hanger control fluid passage 110, and then to the downhole equipment through the control line 120. Well fluid flows upward through the production tubing 136 and the tubing hanger 108, then into tree 104 and out through a flowline (not shown). During production, there may be a need to operate the downhole equipment. For example, production fluid flow up through the production tubing may need to be stopped such as for situations when workover operations are needed. Other embodiments can include a control unit 130 up at the surface or subsea but remotely from the tree 104. It is not necessary for the control unit 130 to be adjacent to the subsea tree 104. Alternatively, another embodiment may include an intermediate connector 138, as shown in FIG. 1. The intermediate connector 138 can include valves to control hydraulic fluid and pressure through the control line 132 along with, or instead of, valve 114.

Also, as an added benefit, if the tree 104 is removed, the valve 114 located on the tubing spool 106 can be closed first, and then tested before the subsea tree 104 is removed. Normally, when a tree is removed, there is no way to test if the auxiliary line valves will close because the mating coupler on the tree is holding them open until the removal process is complete.

Not having wetmate couplers or electrical connections in the annulus surrounding the production tubing also helps prevent issues related to the couplers or connections wearing out from cyclical pressure applications, being exposed to hydrocarbons, and the effects of gas injection.

In addition, the present embodiments allow the wetmate connections to be made up and tested while a blowout preventer (BOP) is in place, using the same connector. This is helpful when batch drilling is planned, as it removes risk associated with bringing back the BOP stack if the tree to hanger connections are damaged using a more traditional concept.

Another embodiment can include a remotely-operated vehicle (ROV) with controls and connections for providing electrical and/or hydraulic control for the downhole equipment during well operations. As an example, a hydraulic line similar to line 132 extends from the ROV and connects with a connector 134, where the connector 134 is coupled to the valve 114, which leads to the tubing spool fluid supply passages 112 and then to the tubing hanger control fluid passages 110.

By connecting to the control lines 120 from outside the tubing spool 106, a slim-bore tubing hanger as described can be used in a conventional tree installation, the tubing hanger maximizing the number of downhole passages for carrying hydraulic pressure. The auxiliary passages are located below the running-tool and locking profiles, and seals in the passages provide for easy make-up of the communication paths during assembly. Additionally, the downhole hydraulic and electrical connections in the tubing spool are protected from the environment using an annular barrier seal when the subsea tree is removed underwater.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A subsea completion for a subsea well including:

a tubing spool including:

a central bore and a side wall;

a fluid supply passage extending through the side wall; and an electrical supply passage extending through the side wall;

a tubing hanger including a production bore and being moveable into a landed position within the tubing spool, the tubing hanger including:

a control fluid passage outside the production bore to supply fluid for a downhole function; and an electrical passage to supply electrical power for a downhole function;

a fluid coupling including an axially extending flow passage, the fluid coupling being made by the landing of the tubing hanger in the tubing spool and to supply fluid to the tubing hanger control fluid passage from the tubing spool fluid supply passage when the tubing hanger is in the landed position;

an electrical coupling to electrically connect the tubing spool electrical supply passage and the tubing hanger electrical passage when the tubing hanger is in the landed position;

a valve mounted to the outside of the tubing spool to control fluid flow through the tubing, spool fluid supply passage;

a control system including:

a fluid conduit connected to the valve to provide fluid through the valve and to the tubing spool fluid supply passage from outside the tubing spool; and an electric conduit to provide electricity to the tubing spool electrical supply passage from outside the tubing spool; and a subsea production tree installable on the tubing spool and connectable with the tubing hanger production bore for fluid communication.

2. The completion of claim 1, further comprising: a control fluid line extendable from the tubing hanger downhole into the well to communicate fluid from the tubing hanger fluid passage.

3. The completion of claim 1, further comprising: an electrical line extendable from the tubing hanger downhole into the well to communicate electricity from the tubing hanger electrical passage.

4. The completion of claim 1, wherein the fluid coupling is actuatable by moving the tubing hanger into the landed position.

5. The completion of claim 1, wherein the production tree is directly connectable with the tubing hanger only by a stab connection with the tubing hanger production bore.

6. The completion of claim 1, wherein the valve allows shut-off protection at the tubing spool.

7. The completion of claim 2, further including equipment locatable downhole in the well controllable by fluid communication through the control fluid line.

8. The completion of claim 1, wherein the subsea production tree is connected to the tubing hanger in any rotational orientation.

9. The completion of claim 1, wherein the control system is integral with the subsea production tree.

10. The completion of claim 1, further including more than one auxiliary line in the tubing hanger and corresponding tubing spool auxiliary passages and auxiliary lines.

11. The completion of claim 1, wherein the control system is controlled from the surface.

* * * * *